US008100501B2

(12) United States Patent
Kojima et al.

(10) Patent No.: US 8,100,501 B2
(45) Date of Patent: Jan. 24, 2012

(54) LIQUID EJECTION APPARATUS, IMAGE FORMING APPARATUS, AND LIQUID EJECTION METHOD

(75) Inventors: Toshiya Kojima, Kanagawa-ken (JP); Gentaro Furukawa, Kanagawa-ken (JP)

(73) Assignee: Fujifilm Corporation, Tokyo (JP)

( * ) Notice: Subject to any disclaimer, the term of this patent is extended or adjusted under 35 U.S.C. 154(b) by 948 days.

(21) Appl. No.: 12/003,831

(22) Filed: Jan. 2, 2008

(65) Prior Publication Data

US 2008/0170098 A1 Jul. 17, 2008

(30) Foreign Application Priority Data

Jan. 15, 2007 (JP) ..... 2007-005994

(51) Int. Cl.
*B41J 2/015* (2006.01)
*B41J 2/17* (2006.01)

(52) U.S. Cl. ..... 347/21; 347/97

(58) Field of Classification Search ..... 347/21, 347/97

See application file for complete search history.

(56) References Cited

U.S. PATENT DOCUMENTS 4,019,188 A * 4/1977 Hochberg et al. ..... 347/83
7,874,656 B2 1/2011 Ota et al.

FOREIGN PATENT DOCUMENTS

JP 2003-226025 A 8/2003
JP 2005-41048 A 2/2005
JP 2006-326855 A 12/2006

OTHER PUBLICATIONS

JP Office Action issued in corresponding JP Application No. 2007-005994 on Nov. 24, 2011.

* cited by examiner

*Primary Examiner* — Jerry Rahll
(74) *Attorney, Agent, or Firm* — Birch, Stewart, Kolasch & Birch, LLP

(57) ABSTRACT

The liquid ejection apparatus includes: a recording head which includes a nozzle and an ejection device, the ejection device ejecting an ejection liquid through the nozzle by applying pressure to the ejection liquid in the recording head; a liquid accommodation unit which is in connection with the recording head and which accommodates a gas, the ejection liquid to be supplied to the recording head, and a non-volatile liquid having a permeability to the gas lower than the ejection liquid, the ejection liquid being separated from the gas by the non-volatile liquid; and a pressure control unit which controls pressure of the ejection liquid in the liquid accommodation unit by moving the gas into and out of the liquid accommodation unit.

12 Claims, 15 Drawing Sheets

RELATED-ART

LIQUID EJECTION APPARATUS, IMAGE FORMING APPARATUS, AND LIQUID EJECTION METHOD

BACKGROUND OF THE INVENTION

1. Field of the Invention

The present invention relates to a liquid ejection apparatus, an image forming apparatus and a liquid ejection method, and more particularly, to a liquid ejection apparatus and a liquid ejection method whereby an ejection liquid can be ejected stably by securing gas barrier properties and preventing aggregation or sedimentation of the coloring material, or the like, contained in the ejection liquid.

2. Description of the Related Art

Japanese Patent Application Publication No. 2005-041048 discloses a liquid spraying apparatus which is mainly constituted of a recording head 222, an ink cartridge 221, a pressure control unit 223, as shown in FIG. 15. The ink cartridge 221 is connected with a pump 238 in the pressure control unit 223 via a pressure control valve 229 by means of a pressure control tube 237. The pressure sensor 236, which is connected with the ink cartridge 221 via the pressure control tube 237, measures an air pressure in the ink cartridge 221.

By means of this composition, it is possible to keep the air pressure in the ink cartridge 221, in which an ink bag 231 is accommodated, to a negative pressure, by means of a control circuit 239 in the pressure control unit 223 controlling the pressure control valve 229 and the pump 238 on the basis of a determination signal from the pressure sensor 236.

However, in Japanese Patent Application Publication No. 2005-041048, the ink bag 231 is composed of a member having plastic properties and gas barrier properties. More specifically, for example, the ink bag is composed of an aluminum laminate film in which an aluminum film is interposed between an outer film (a nylon film) and an inner film (a polyethylene film).

Therefore, the ink bag 231 has a thickness of several 100 μm and has relatively high rigidity, and consequently, local creasing or wrinkling occurs as the ink is consumed. If the local creasing or wrinkling occurs in the ink bag 231, then the convection flow in the ink liquid (i.e., ejection liquid) stagnates in the corresponding portion, and there is a possibility that aggregation or sedimentation of the coloring material, or the like, contained in the ink liquid will occur. If the aggregate or sediment caused by the aggregation or sedimentation of the coloring material, or the like, flows into the recording head during ejection of the ink, then ejection failure will arise.

Another composition is possible in which the ink bag 231 is provided with folds in the form of a three-dimensional folding composition or accordion structure, but in this case also, convection flow of the ink in the region of the fold is prevented, and consequently, aggregated material and sediment of the ink is generated, and this aggregate and sediment is supplied to the recording head, giving rise to pressure loss and blockages of nozzles.

SUMMARY OF THE INVENTION

The present invention has been contrived in view of the foregoing circumstances, an object thereof being to provide a liquid ejection apparatus, an image forming apparatus and a liquid ejection method, whereby an ejection liquid can be ejected stably by securing gas barrier properties and preventing aggregation or sedimentation of the coloring material, or the like, contained in the ejection liquid.

In order to attain the aforementioned object, the present invention is directed to a liquid ejection apparatus including: a recording head which includes a nozzle and an ejection device, the ejection device ejecting an ejection liquid through the nozzle by applying pressure to the ejection liquid in the recording head; a liquid accommodation unit which is in connection with the recording head and which accommodates a gas, the ejection liquid to be supplied to the recording head, and a non-volatile liquid having a permeability to the gas lower than the ejection liquid, the ejection liquid being separated from the gas by the non-volatile liquid; and a pressure control unit which controls pressure of the ejection liquid in the liquid accommodation unit by moving the gas into and out of the liquid accommodation unit.

In this aspect of the present invention, since a non-volatile liquid having a lower gas permeability than the liquid for ejection (i.e., ejection liquid) is present between the gas and the liquid for ejection, then it is possible to adjust the pressure while suppressing dissolution of the gas into the liquid for ejection. Furthermore, even in cases where liquid for ejection has been ejected from the recording head and the liquid for ejection inside the liquid accommodation unit has been consumed, no parts which inhibit convection currents arise within the liquid for ejection, and consequently, there is no occurrence of aggregate or sediment of the coloring material, or the like. Therefore, it is possible to achieve a state of stable ejection from the recording head.

Preferably, the non-volatile liquid has a specific gravity less than the ejection liquid.

In this aspect of the present invention, the layer of the non-volatile liquid is formed over the layer of the ejection liquid, and it is possible to achieve a state of separation between the liquid for ejection and the gas, reliably, by means of the non-volatile liquid. It is therefore possible to adjust the pressure while suppressing dissolution of the gas into the liquid for ejection more reliably, and moreover, the occurrence of regions where convection currents are inhibited in the liquid for ejection is prevented, and hence there is no occurrence of aggregate or sediment of the coloring material, or the like. Consequently, it is possible to achieve a state of stable ejection from the recording head.

Preferably, the liquid accommodation unit includes a porous member impregnated with the non-volatile liquid; and the ejection liquid is separated from the gas by the non-volatile liquid held in the porous member.

In this aspect of the present invention, by providing the solid porous member impregnated with the non-volatile liquid, it is possible to prevent the effects of external vibrations and hence to stabilize the pressure of the liquid for ejection inside the liquid accommodation unit. Moreover, by impregnating the solid porous member with the non-volatile liquid, it is possible to prevent the non-volatile liquid from flowing into the recording head, and since there is no shaking of the liquid surface, it is also possible to minimize the remaining amount of the liquid for ejection.

Preferably, the liquid accommodation unit includes an elastic film disposed between the ejection liquid and the non-volatile liquid.

In this aspect of the present invention, the liquid for ejection and the non-volatile liquid are separated by the elastic film, and therefore there are no restrictions on the physical properties (e.g., the specific gravity or the miscibility with respect to the liquid for ejection) of the non-volatile liquid to be used. Consequently, it is also possible to use a relatively inexpensive non-volatile liquid.

Even if the liquid for ejection is used up, the non-volatile liquid never flows into the recording head, and therefore it is possible to use up the liquid for ejection, completely. Moreover, even in cases where the liquid for ejection inside the liquid accommodation unit has been consumed due to ejection of the liquid for ejection from the recording head, no parts which inhibit convection currents arise within the liquid for ejection, and consequently, there is no occurrence of aggregate or sediment of the coloring material, or the like. Furthermore, even if the elastic film has gas permeable properties, it is possible to maintain the deaerated state of the liquid for ejection due to the presence of the non-volatile liquid.

Preferably, the liquid accommodation unit further includes an elastic film disposed between the non-volatile liquid and the gas.

In this aspect of the present invention, since a non-volatile liquid is filled in between the two elastic films, then even if the liquid accommodation unit is large in size, it is possible to reduce the volume of non-volatile liquid, and therefore costs can be lowered.

Preferably, the liquid accommodation unit includes an elastic film supporting member which movably supports the elastic film.

In this aspect of the present invention, the elastic film supporting member and the elastic film move in accordance with the amount of the liquid for ejection, and it is possible to restrict the amount of deformation of the elastic film to a uniform range, during a normal recording operation. It is therefore possible to minimize the non-volatile liquid and to lower costs, and since the elastic film does not maintain a state of great deformation over a long period of time, then the life of the elastic film can be extended.

Here, "during a normal recording operation" means during carrying out the normal recording operations, apart from the initial filling of the liquid for ejection or maintenance operations.

Preferably, the non-volatile liquid has a light transmittance less than the ejection liquid.

Preferably, the non-volatile liquid has a light reflectance greater than the ejection liquid.

In this aspect of the present invention, even if the liquid for ejection is transparent, it is still possible to determine the position of the liquid for ejection, reliably.

In order to attain the aforementioned object, the present invention is also directed to a liquid ejection apparatus including: a recording head which includes a nozzle and an ejection device, the ejection device ejecting an ejection liquid through the nozzle by applying pressure to the ejection liquid in the recording head; a liquid accommodation unit which is in connection with the recording head and which accommodates a gas, the ejection liquid to be supplied to the recording head, and a non-volatile liquid that is a magnetic fluid and has a permeability to the gas lower than the ejection liquid, the ejection liquid being separated from the gas by the non-volatile liquid; a magnetic force generating device which applies a magnetic force to the non-volatile liquid; and a pressure control unit which controls pressure of the ejection liquid in the liquid accommodation unit by adjusting the magnetic force of the magnetic force generating device.

In this aspect of the present invention, it is possible to achieve continuous operation without creating oscillations in the gas of the liquid accommodating unit, and it is possible to achieve more accurate adjustment of the pressure of the liquid for ejection.

In order to attain the aforementioned object, the present invention is also directed to a liquid ejection apparatus including: a recording head which includes a nozzle and an ejection device, the ejection device ejecting an ejection liquid through the nozzle by applying pressure to the ejection liquid in the recording head; a liquid accommodation unit which is in connection with the recording head and which accommodates a gas, the ejection liquid to be supplied to the recording head, and a non-volatile liquid having a permeability to the gas lower than the ejection liquid, the liquid accommodation unit including an inelastic member that separates the ejection liquid from the gas, and an elastic film that separates the non-volatile liquid from the ejection liquid and the gas; and a pressure control unit which controls pressure of the ejection liquid in the liquid accommodation unit by moving the gas into and out of the liquid accommodation unit.

In this aspect of the present invention, a portion of the liquid for ejection makes contact with the non-volatile liquid via the elastic film, and moreover, a portion thereof makes contact with the gas via the non-elastic member. Consequently, even if the liquid accommodation unit is large in size, then it is possible to use only a small amount of non-volatile liquid, and hence costs can be lowered.

In order to attain the aforementioned object, the present invention is also directed to an image forming apparatus including one of the above-described liquid ejection apparatuses.

In order to attain the aforementioned object, the present invention is directed to a liquid ejection method including the steps of: ejecting an ejection liquid from a nozzle of a recording head by applying pressure to the ejection liquid in the recording head; and controlling pressure of the ejection liquid in a liquid accommodation unit which is in connection with the recording head and which accommodates the ejection liquid and a gas by moving the gas into and out of the liquid accommodation unit, while the ejection liquid is supplied from the liquid accommodation unit to the recording head, the ejection liquid in the liquid accommodation unit being separated from the gas by a non-volatile liquid having a permeability to the gas lower than the ejection liquid.

According to the present invention, it is possible to achieve a state of stable ejection of the liquid for ejection, by ensuring gas barrier properties, and preventing aggregation or sedimentation of the coloring material, or the like, which is contained in the liquid for ejection.

BRIEF DESCRIPTION OF THE DRAWINGS

The nature of this invention, as well as other objects and advantages thereof, will be explained in the following with reference to the accompanying drawings, in which like reference characters designate the same or similar parts throughout the figures and wherein.

DETAILED DESCRIPTION OF THE PREFERRED EMBODIMENTS

Description of Liquid Ejection Apparatus and Method

Figure 1:
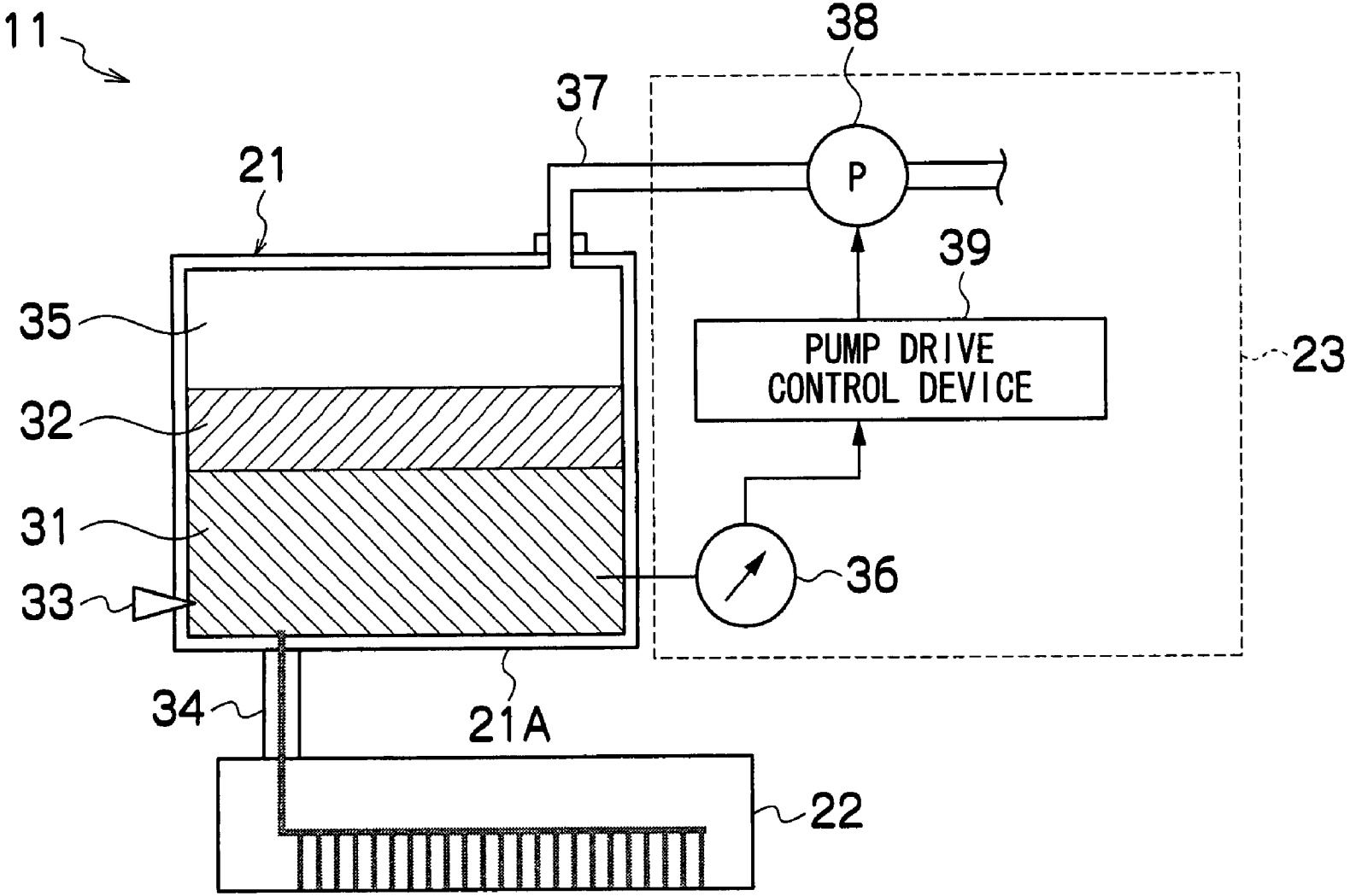
FIG. 1 is a general view of a liquid ejection apparatus according to an embodiment of the present invention.

FIG. 1 is a general schematic drawing of a liquid ejection apparatus according to an embodiment of the present invention. As shown in FIG. 1, a liquid ejection apparatus 11 according to the present embodiment is principally constituted by a liquid accommodation unit 21, a recording head 22, a pressure adjustment device 23, and the like. The liquid accommodation unit 21 has an enclosure 21A in which an ejection liquid (i.e., liquid to be ejected from the recording head 22) 31, a non-volatile liquid 32 and air 35 are accommodated, and a liquid detection device 33 is also provided in the enclosure 21A. The liquid accommodation unit 21 is connected to the recording head 22 by means of a connection channel 34. The pressure adjustment device 23 is constituted by a pressure measurement device 36 which measures the pressure of the ejection liquid 31 in the enclosure 21A of the liquid accommodation unit 21, a pump 38 disposed in a flow channel 37 connected to the liquid accommodation unit 21, a pump drive control device 39 which controls the driving of the pump 38, or the like.

The non-volatile liquid 32 accommodated inside the enclosure 21A of the liquid accommodation unit 21 has properties whereby the non-volatile liquid 32 does not mix with the ejection liquid 31. For example, in a case where the ejection liquid 31 is a water-based ink, a non-aqueous liquid may be used. Since the non-volatile liquid 32 has properties whereby the non-volatile liquid 32 does not mix with the ejection liquid 31, then the ejection liquid 31 and the non-volatile liquid 32 are separated from each other.

Moreover, the non-volatile liquid 32 has a specific gravity less than the ejection liquid 31. Therefore, a layer of the non-volatile liquid 32 is formed on top of the surface of the ejection liquid 31, in the liquid accommodation unit 21.

Moreover, the non-volatile liquid 32 has a relatively low permeability to gas (e.g., air). Specific examples of the non-volatile liquid 32 include a fluorine oil and a polyolefin, and the like. The non-volatile liquid 32 thus suppresses the permeation of air 35.

Furthermore, in order to judge whether or not the residual amount of ejection liquid 31 is insufficient, the liquid detection device 33 for detecting the non-volatile liquid 32 is disposed in the vicinity of the bottom surface of the liquid accommodation unit 21. The liquid detection device 33 includes a sensor that measures a light transmittance or light reflectance and judges the presence of the non-volatile liquid 32 on the basis of the measured light transmittance or light reflectance. By means of this composition, the liquid detection device 33 detects the non-volatile liquid 32 when the level of the non-volatile liquid 32 is lowered to a position corresponding to the liquid detection device 33 as the ejection liquid 31 is consumed. Desirably, the liquid detection device 33 is disposed in a position slightly distanced from the bottom surface of the liquid accommodation unit 21, in order to prevent the non-volatile liquid 32 from flowing into the recording head 22 if the liquid surface is shaken. More specifically, desirably, the liquid detection device 33 is disposed in a position distanced 5 mm to 20 mm from the bottom surface of the liquid accommodation unit 21.

In the liquid ejection apparatus shown in FIG. 1 according to the present embodiment which has the composition described above, the pressure adjustment device 23 maintains the pressure of the air 35 inside the enclosure 21A of the liquid accommodation unit 21 at a uniform pressure. In this case, since the non-volatile liquid 32 which is present between the air 35 and the ejection liquid 31 has a relatively low permeability to gas (e.g., the air 35), then it serves as a gas barrier and thereby suppresses the dissolution of the air 35 into the ejection liquid 31. Since the non-volatile liquid 32 does not mix with the ejection liquid 31, then the non-volatile liquid 32 remains separate from the ejection liquid 31. Moreover, even when the ejection liquid 31 is ejected from the recording head 22 and the ejection liquid 31 in the enclosure 21A of the liquid accommodation unit 21 is therefore consumed, no portions where the convection flow is inhibited occur within the ejection liquid 31, and hence there is a beneficial effect in preventing aggregation or sedimentation of the coloring material, or the like. Thus, the ejection liquid 31 can be ejected stably from the recording head 22.

The non-volatile liquid 32 has a light transmittance lower than the ejection liquid 31, or it has a light reflectance higher than the ejection liquid 31. The liquid detection device 33 is therefore able to detect the non-volatile liquid 32 by measuring the light transmittance or the light reflectance of the non-volatile liquid 32. Therefore, even if the ejection liquid 31 is transparent, it is possible to judge whether or not the ejection liquid 31 is insufficient, reliably and inexpensively. The non-volatile liquid 32 may be, for example, a fluorinated oil or polyolefin mixed with an opaque (white or gray) silicone oil, or a fluorinated oil which contains pigment particles dispersed therein and coated with a fluorine-based polymer to form capsules.

In the liquid ejection apparatus 11 according to the present embodiment which has the above-described composition, the pressure of the ejection liquid 31 in the enclosure 21A of the liquid accommodation unit 21 is controlled to a uniform pressure by means of the pressure adjustment device 23 causing the air 35 to exit from or enter into the enclosure 21A of the liquid accommodation unit 21, and in this controlled pressure state, the ejection liquid 31 in the enclosure 21A of the liquid accommodation unit 21 is supplied via the connection channel 34 to the recording head 22, and the ejection liquid 31 is ejected from the nozzles 151 (shown in not FIG. 1 but FIG. 13B) by means of ejection devices (piezoelectric elements 158, or the like) inside the recording head 22, which are described hereinafter.

Figure 2:
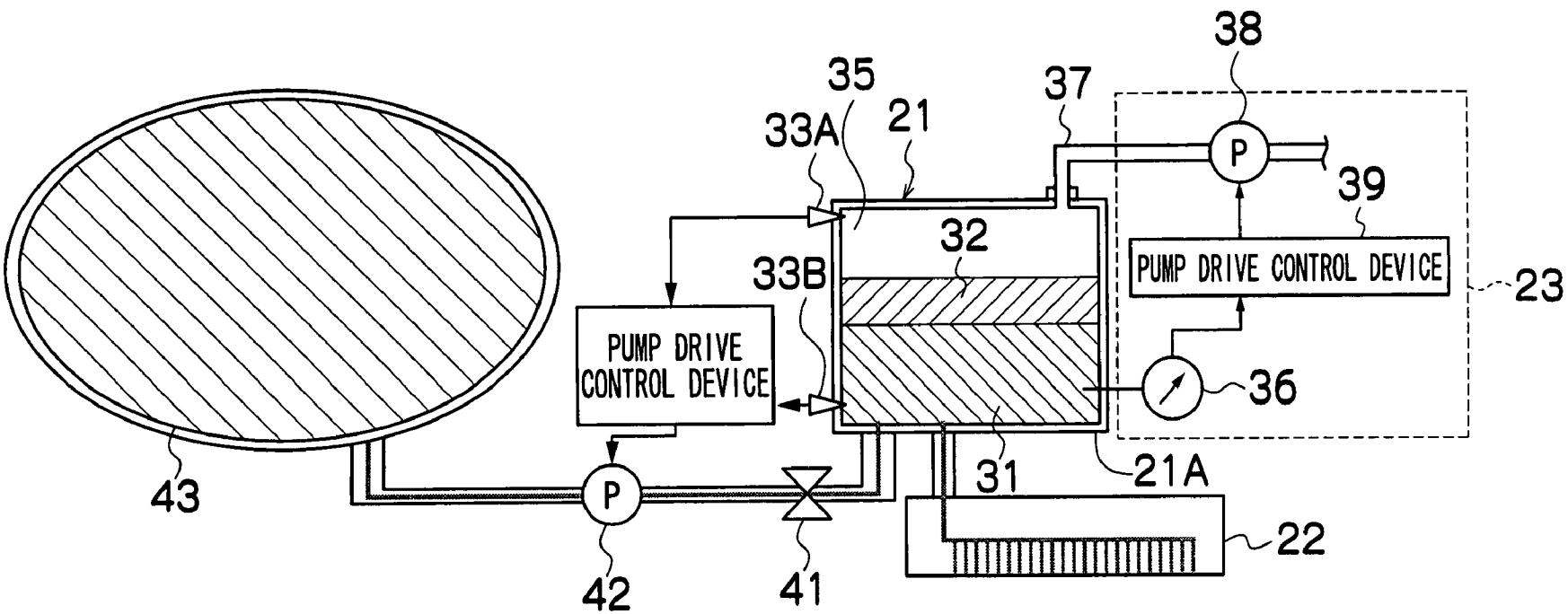
FIG. 2 is a diagram showing another configuration of the liquid ejection apparatus shown in FIG. 1 which is further provided with a main tank.

FIG. 2 is a diagram showing another compositional example of the liquid ejection apparatus shown in FIG. 1 which is further provided with a main tank 43. As shown in FIG. 2, the liquid accommodation unit 21 is used as a sub tank, and the liquid accommodation unit 21 (i.e., the sub tank)

is connected to the main tank 43 via a valve 41 and a pump 42. The ejection liquid 31 is supplied from the main tank 43 to the liquid accommodation unit 21 (i.e., the sub tank), while the pressure of the ejection liquid 31 in the liquid accommodation unit 21 is controlled.

Moreover, liquid detection devices (33A and 33B) for detecting the non-volatile liquid 32 are disposed in the vicinity of the upper surface and the bottom surface of the liquid accommodation unit 21. The liquid detection device 33A, which is disposed in the vicinity of the upper surface, detects the non-volatile liquid 32 when the level of the non-volatile liquid 32 is heightened, and the liquid detection device 33A judges whether the liquid accommodation unit 21 is full with the ejection liquid 31 and the non-volatile liquid 32 (i.e., whether the non-volatile liquid 32 is about to flow out to the pump 38). On the other hand, the liquid detection device 33B, which is disposed in the vicinity of the lower surface, detects the non-volatile liquid 32 when the level of the non-volatile liquid 32 is lowered, and the liquid detection device 33B judges whether or not the ejection liquid 31 is insufficient, by determining the presence of the non-volatile liquid 32. Desirably, the liquid detection device 33B is disposed in a position slightly distanced from the bottom surface of the liquid accommodation unit 21, in order to prevent the non-volatile liquid 32 from flowing in to the recording head 22 if the liquid surface is shaken. More specifically, desirably, the liquid detection device 33B is disposed in a position distanced 5 mm to 20 mm from the bottom surface of the liquid accommodation unit 21.

According to the embodiment shown in FIG. 2, which has the composition described above, in addition to the effects of the embodiment shown in FIG. 1, beneficial effects are obtained in that it is possible to carry out large-volume printing or printing over a long period of time, by forming the main tank 43 to have a large capacity and by enabling detachment and replacement of same.

Figure 3:
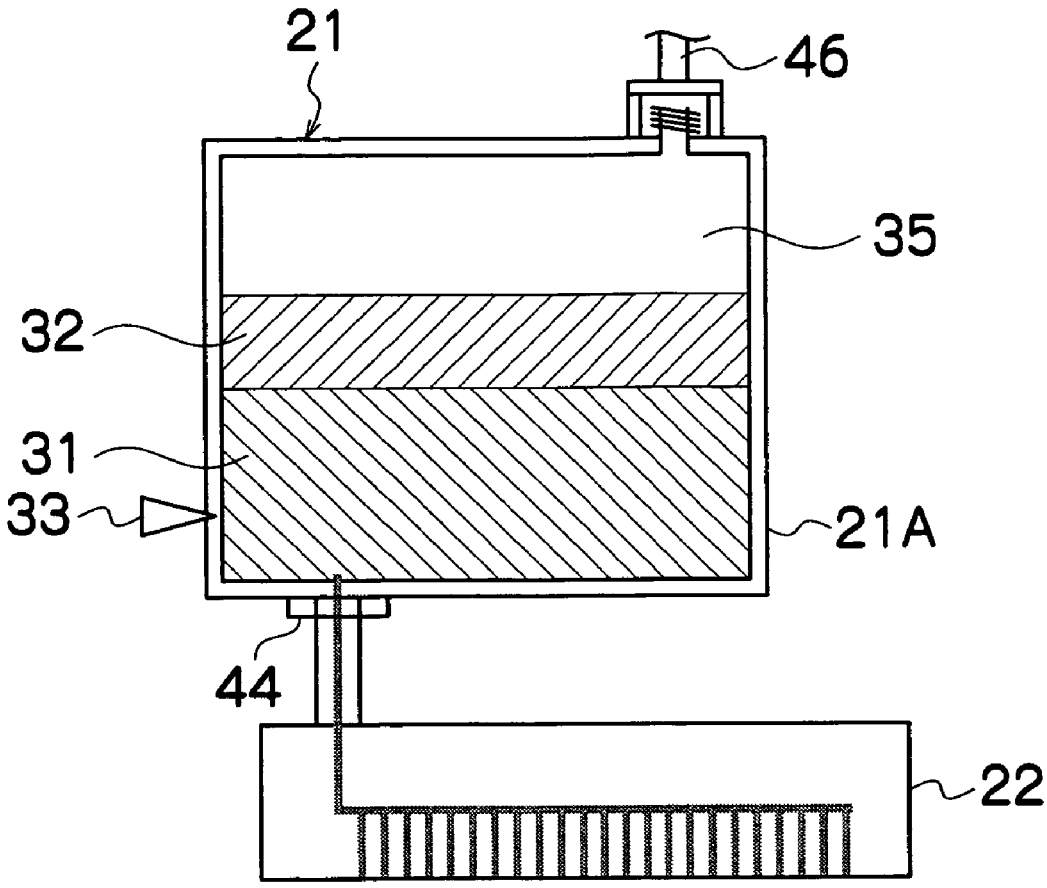
FIG. 3 is a diagram showing a configuration of a liquid ejection apparatus which includes a liquid accommodation unit of cartridge type and a differential pressure regulating valve instead of a pressure adjustment device.

FIG. 3 is a diagram showing another compositional example of the liquid ejection apparatus shown in FIG. 1 in which a cartridge type of the liquid accommodation unit 21 is used, and a differential pressure regulating valve 46 is provided instead of the pressure adjustment device 23. As shown in FIG. 3, by using a cartridge type of the liquid accommodation unit 21, it becomes possible to detach and replace the constituent parts on the upstream side of the connecting member 44. The pressure of the ejection liquid 31 in the liquid accommodation unit 21 is adjusted by means of not the pressure adjustment device 23 but the differential pressure regulating valve 46. Moreover, the liquid detection device 33 for detecting the non-volatile liquid 32 is disposed in the vicinity of the bottom surface of the liquid accommodation unit 21. Desirably, the liquid detection device 33 is disposed in a position slightly distanced from the bottom surface of the liquid accommodation unit 21, in order to prevent the non-volatile liquid 32 from flowing into the recording head 22 when the liquid surface is shaken. More specifically, desirably, the liquid detection device 33 is disposed at a position distanced 5 mm to 20 mm from the bottom surface of the liquid accommodation unit 21.

According to the embodiment shown in FIG. 3, which has the composition described above, in addition to the beneficial effects of the liquid ejection apparatus 11 shown in FIG. 1, since a cartridge type of the liquid accommodation unit 21 is used, then there is no need to provide a pump for supplying the ejection liquid 31, or the like, and since the differential pressure regulating valve 46 is provided, then there is no need to provide a pump for adjusting the pressure of the ejection liquid 31 in the liquid accommodation unit 21, or the like. Consequently, it is possible to make the liquid ejection apparatus more compact in size as well as reducing the cost of the apparatus, and furthermore, since control of a pump, and the like, is not required, then it is possible to reduce the power consumption.

Figure 4:
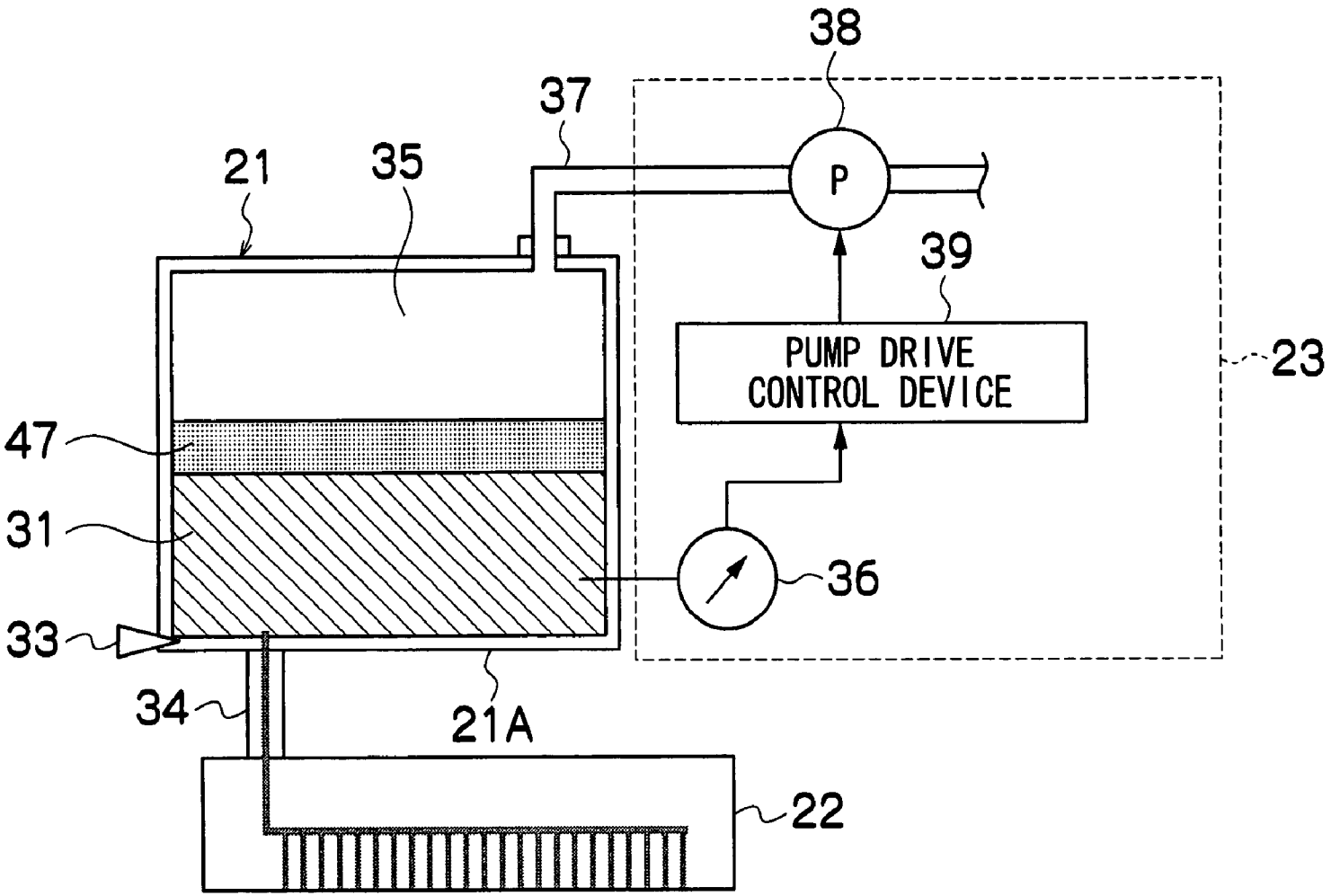
FIG. 4 is a diagram showing an example in which a solid porous member is impregnated with a non-volatile liquid.

FIG. 4 is a diagram showing another compositional example of the liquid ejection apparatus shown in FIG. 1, in which a solid porous member 47 impregnated with the non-volatile liquid 32 is further provided. As shown in FIG. 4, the solid porous member 47 impregnated with the non-volatile liquid 32 is disposed on the surface of the ejection liquid 31, and the solid porous member 47 is movable up and down according to the change in the level of the ejection liquid 31. Furthermore, the liquid detection device 33 for detecting the non-volatile liquid 32 is disposed in the vicinity of the bottom surface of the liquid accommodation unit 21. In the embodiment shown in FIG. 4, shaking of the liquid surface does not occur, and therefore it is desirable to dispose the liquid detection device 33 at a position that is extremely near to the bottom surface of the liquid accommodation unit 21. More specifically, desirably, it is disposed at a position distanced 0 mm to 5 mm from the bottom surface of the liquid accommodation unit 21.

According to the embodiment shown in FIG. 4, which has the composition described above, even in a case where a vibration is transmitted to the liquid accommodation unit 21 from the exterior, since the pressure is kept at a uniform pressure (the pressure variation due to the shaking of the liquid surface can be prevented), then beneficial effects are obtained in that the volume of the liquid droplets ejected from the recording head 22 is kept at a uniform volume, and moreover, the direction of flight of the ejected liquid droplets is kept to a straight direction. Furthermore, beneficial effects are obtained in that even when all of the ejection liquid 31 has been used up, the non-volatile liquid 32 does not flow into the recording head 22, and furthermore, the residual amount of the ejection liquid 31 can be minimized.

Figure 5:
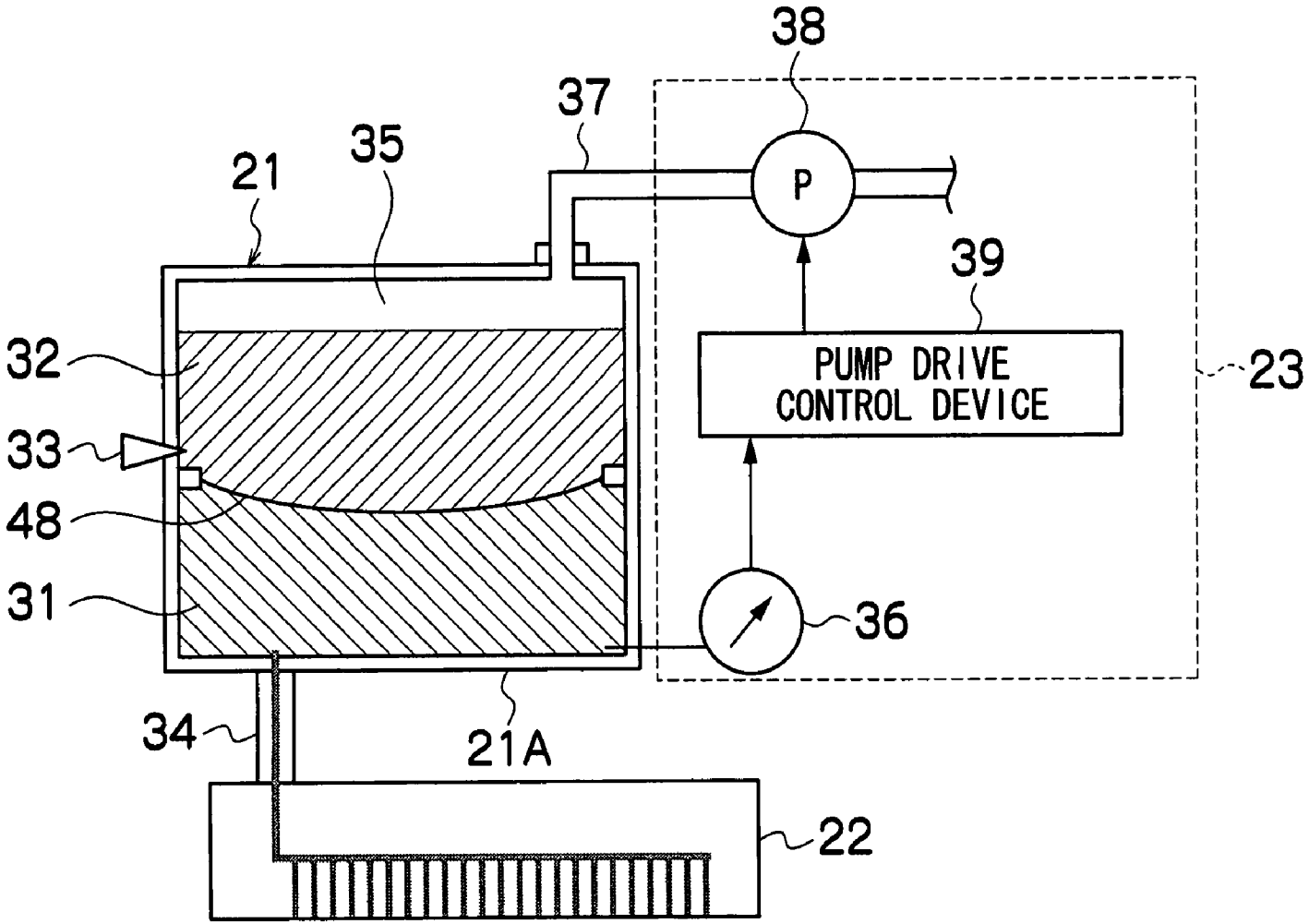
FIG. 5 is a diagram showing an example in which an elastic film is disposed between the ejection liquid and the non-volatile liquid.

FIG. 5 is a diagram showing another compositional example of the liquid ejection apparatus in which an elastic film 48 is disposed between the ejection liquid 31 and the non-volatile liquid 32. As shown FIG. 5, the elastic film 48 is disposed between the ejection liquid 31 and the non-volatile liquid 32, and the edge portions of the elastic film 48 are fixed to the inner walls of the liquid accommodation unit 21. The material of the elastic film 48 is required to be capable of performing a deformation of at least equal capacity to the volume of the ejection liquid 31, and moreover, the material must not be corroded by the ejection liquid 31 or the non-volatile liquid 32. Consequently, the material of the elastic film 48 is selected in accordance with the materials of the ejection liquid 31 and the non-volatile liquid 32. More specifically, a silicone rubber, butyl rubber or ethylene rubber is desirable. A suitable value for the thickness of the elastic film 48 is 0.5 mm to 2.0 mm, taking account of the deformation characteristics and the durability of the film.

Moreover, the liquid detection device 33 for detecting the non-volatile liquid 32 is disposed at a position in the vicinity of the position at which the elastic film 48 is fixed, and preferably, it is disposed at a distance of 0 mm to 5 mm above the fixing position. When the remaining amount of ejection liquid 31 has become low and the level of the non-volatile liquid 32 is lowered, the liquid detection device 33 detects the air 35 (i.e., the absence of the non-volatile liquid 32) and thereby judges whether or not the ejection liquid 31 in the liquid accommodation unit 21 is insufficient.

From the above, according to the embodiment shown in FIG. 5, by providing the elastic film 48, the non-volatile liquid 32 is prevented from coming into direct contact with the ejection liquid 31, and therefore there are no restrictions on the properties (the specific gravity and miscibility with the ejection liquid 31) of the non-volatile liquid 32. Therefore, a beneficial effect is obtained in that a relatively inexpensive material can be used for the non-volatile liquid 32.

Furthermore, beneficial effects are obtained in that even when all of the ejection liquid 31 has been used up, the non-volatile liquid 32 does not flow into the recording head 22, and therefore it is possible to use up the ejection liquid 31 completely. Moreover, the elastic film 48 deforms while maintaining a curved surface shape, and therefore a beneficial effect is obtained in that the convection flow in the ejection liquid 31 is not inhibited, and aggregation or sedimentation of the coloring material, or the like, does not occur. Furthermore, even in a case where the elastic film 48 has a relatively high permeability to the gas (e.g., the air 35), the total permeability to the gas is low due to the presence of the non-volatile liquid 32 which has a relatively low permeability to the gas, and therefore a beneficial effect is obtained in that the deaerated state of the ejection liquid 31 can be preserved.

Figure 6:
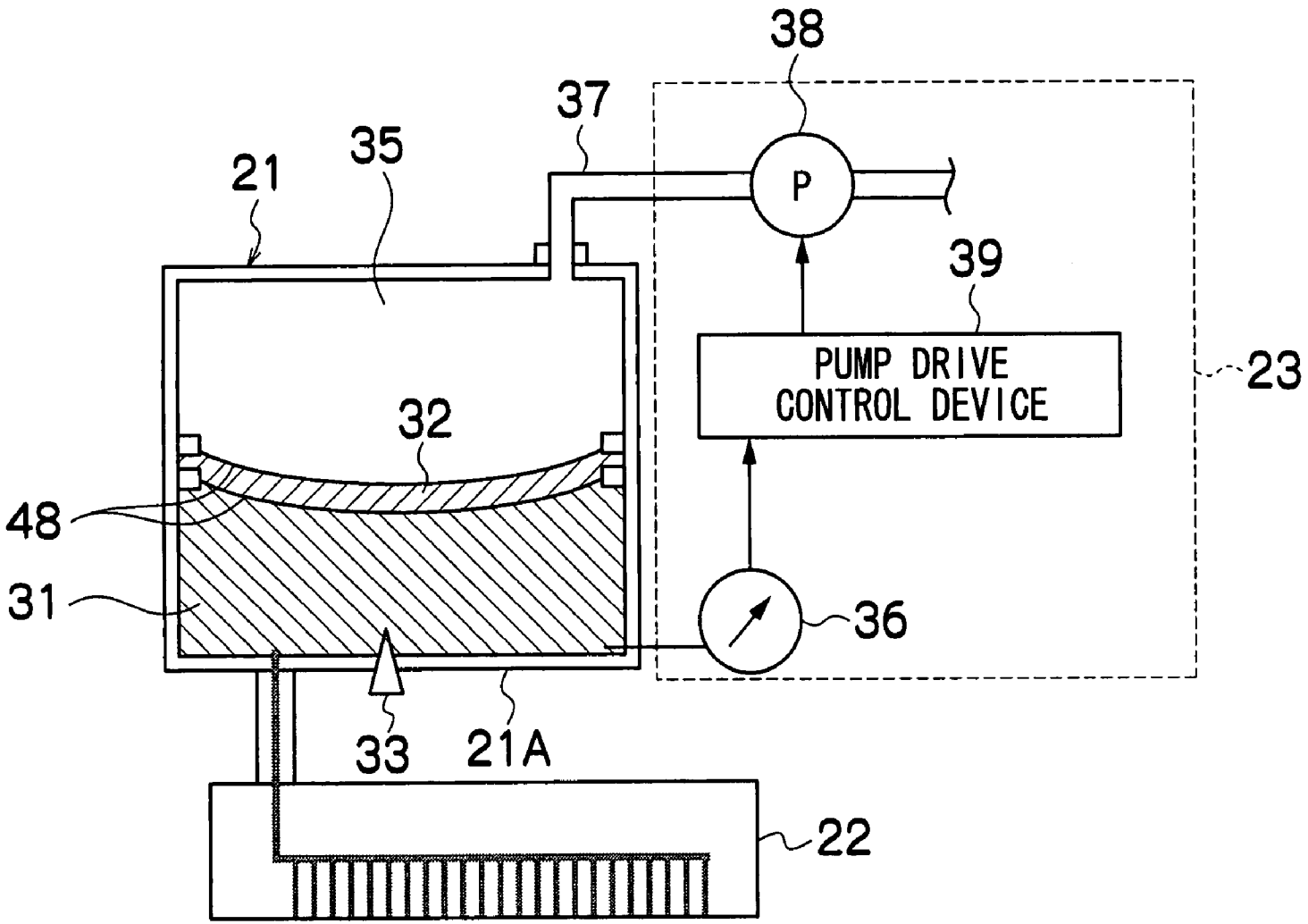
FIG. 6 is a diagram showing an example in which two elastic films are provided.

FIG. 6 is a diagram showing another compositional example of the liquid ejection apparatus in which two elastic films 48 are provided. As shown in FIG. 6, two elastic films 48 are provided, and the non-volatile liquid 32 is filled in between the two elastic films 48. Desirably, the two elastic films 48 have the same material properties and shape (thickness), in such a manner that they have the same shape as each other when they deform. Furthermore, the liquid detection device 33 for detecting the non-volatile liquid 32 is disposed at a position in the vicinity of the central portion of the bottom surface of the liquid accommodation unit 21. When the remaining amount of the ejection liquid 31 is low and the elastic films 48 are deformed downward, the liquid detection device 33 detects the non-volatile liquid 32 and thereby judges whether or not the ejection liquid 31 in the liquid accommodation unit 21 is insufficient.

From the above, according to the embodiment shown in FIG. 6, even if the liquid accommodation unit 21 is large in size, it is possible to reduce the required volume of the non-volatile liquid 32, regardless of the amount of extension of the elastic film 48, and therefore beneficial effects in reducing costs can be achieved.

Figure 7:
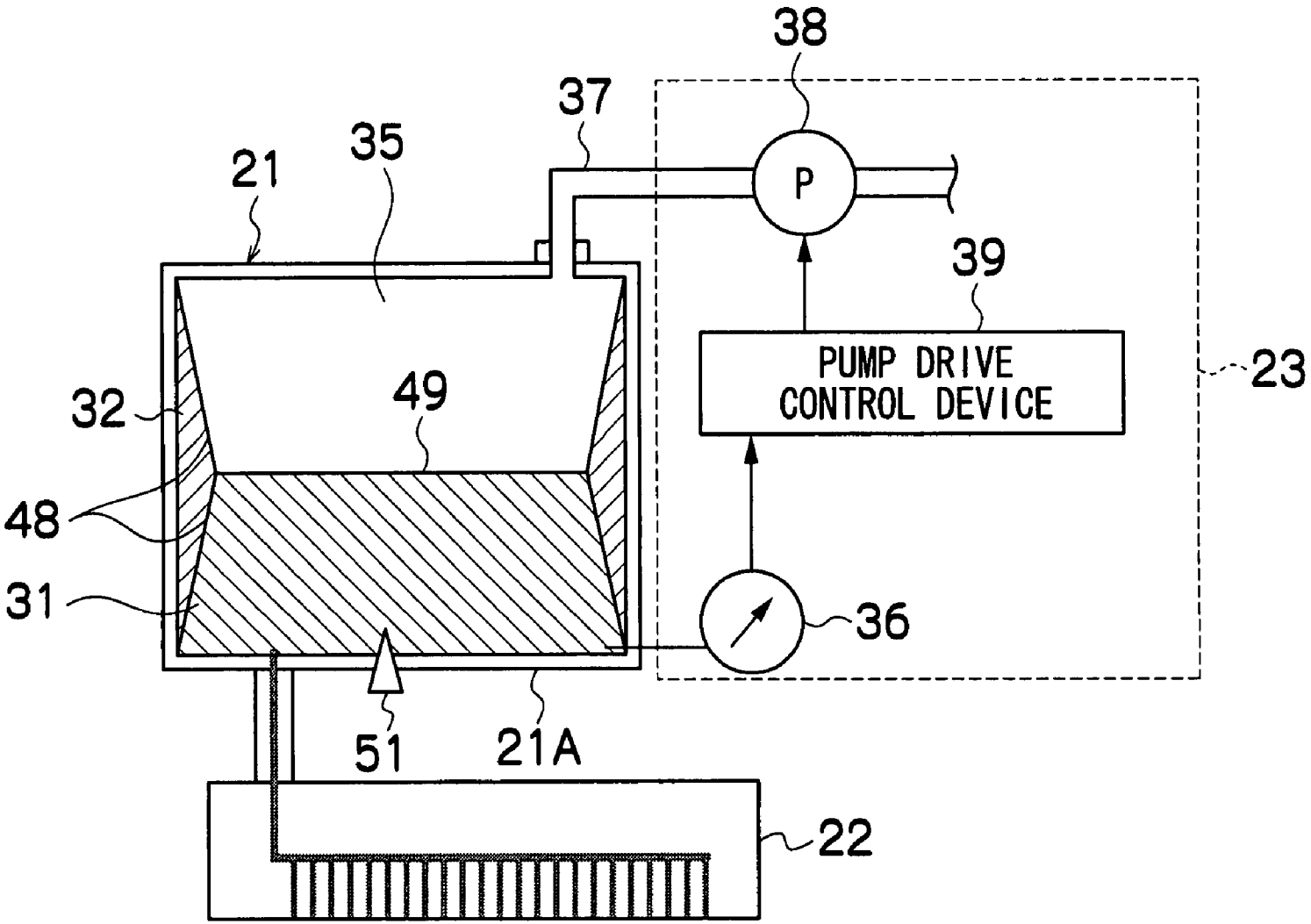
FIG. 7 is a diagram showing an example in which a portion of the ejection liquid is separated from the non-volatile liquid by means of the elastic film.

FIG. 7 is a diagram showing another compositional example of the liquid ejection apparatus in which a portion of the ejection liquid 31 is separated from the non-volatile liquid 32 by the elastic film 48. As shown in FIG. 7, a portion of the ejection liquid 31 makes contact with the non-volatile liquid 32 via the elastic film 48, and a portion thereof makes contact with the air 35 via an inelastic member 49. Furthermore, a portion of the non-volatile liquid 32 makes contact with the air 35 via the elastic film 48.

The member used for the inelastic member 49 is constituted of a material having a maximum elongation of 0% to 10%, and is formed to a substantially planar shape. The inelastic member 49 has a small thickness and a low permeability to the gas. More specifically, it has a gas permeability of 10 $cm^3 \cdot mm/m^2 \cdot 24\ h \cdot 1$ atm or lower, and a thickness of 0.5 mm to 5.0 mm. The material of the inelastic member 49 may be a metal such as stainless steel or aluminum, or a member formed by vapor deposition of aluminum onto a fluorine-based resin such as PFA (which is a copolymer of tetrafluoroethylene and perfluoroalkoxyethylene) or polypropylene (PP), or a dual-layer material composed of a PP layer and a PFA layer.

Furthermore, an inelastic member detector 51 is disposed in the vicinity of the center of the bottom surface of the liquid accommodation unit 21. The inelastic member detector 51 is a sensor which measures a light transmittance or light reflectance. When the ejection liquid 31 is consumed and the inelastic member 49 is lowered, the inelastic member detector 51 detects the inelastic member 49 and thereby judges whether or not the ejection liquid 31 in the liquid accommodation unit 21 is insufficient.

From the above, according to the embodiment shown in FIG. 7, even in a case where the liquid accommodation unit 21 is large in size, it is possible to reduce the required volume of the non-volatile liquid 32, regardless of the amount of extension of the elastic film 48, and therefore beneficial effects in reducing costs can be achieved.

Figure 8:
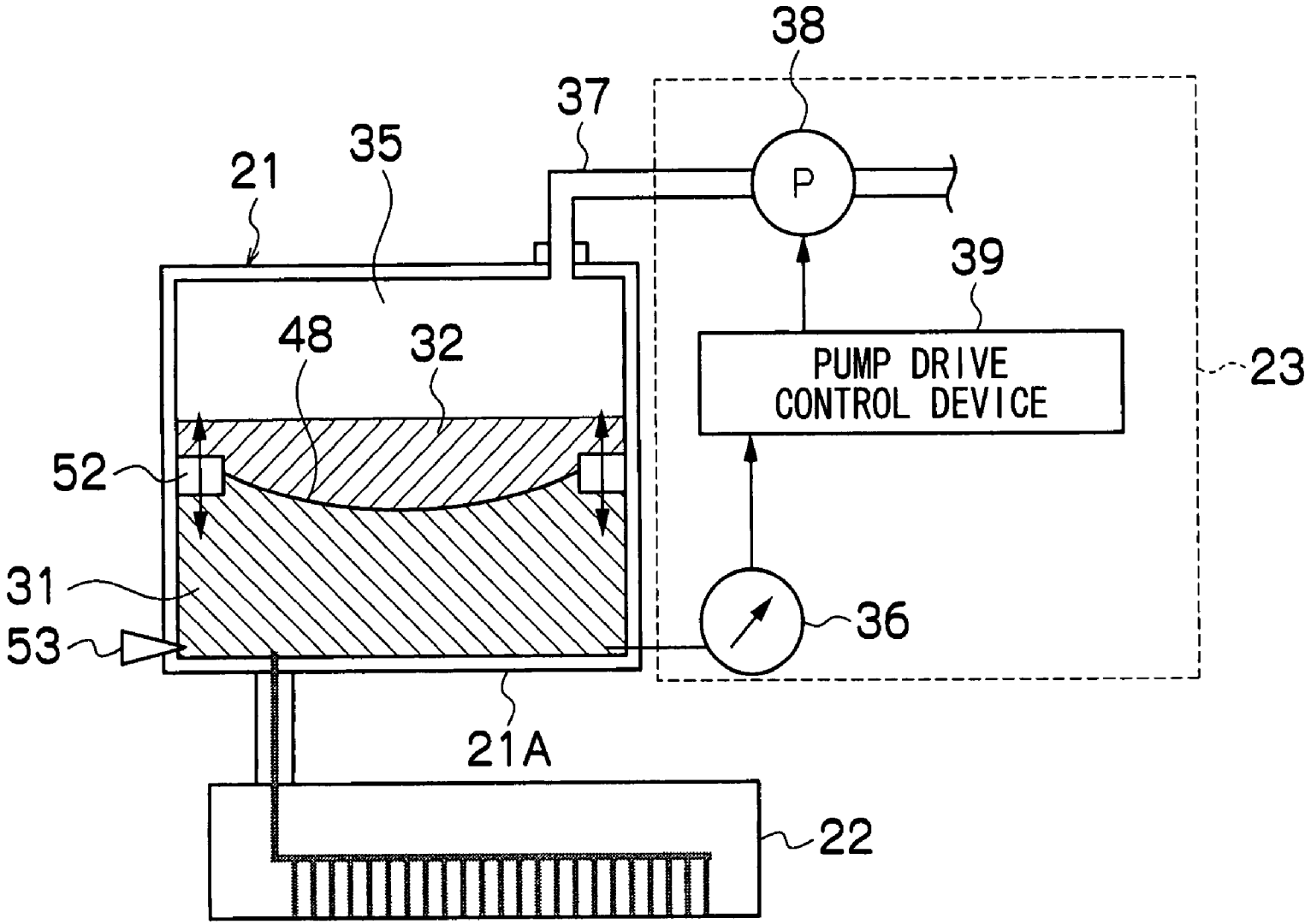
FIG. 8 is a diagram showing an example in which a movable supporting member is disposed at the end portions of the elastic film.

FIG. 8 is a diagram showing another compositional example of the liquid ejection apparatus in which a movable supporting member 52 is disposed at the end portions of the elastic film 48. As shown in FIG. 8, the movable supporting member 52 is disposed at the end portions of the elastic film 48, in contact with the inner walls of the liquid accommodation unit 21. For the supporting member 52, it is possible to use a rubber member made of butyl rubber, natural rubber, or the like, as used in typical syringes or packing elements. The supporting member 52 may be made of the same material as the elastic film 48. If the same material is used, then a merit is obtained in that manufacture can be simplified by using an injection molding process. It is preferable that the supporting member 52 is thick in the direction of movement in order to impart suitable rigidity to the supporting member 52, and it is preferable that the elastic film 48 is thinner than the supporting member 52.

Moreover, desirably, the inner walls of the liquid accommodation unit 21 and the supporting member 52 are formed with a round cylindrical shape. This is because, if a round cylindrical shape is adopted, then the force of friction between the inner walls of the liquid accommodation unit 21 and the supporting member 52 is uniform, and therefore good adhesion between the supporting member 52 and the inner walls of the liquid accommodation unit 21 can be ensured readily.

Furthermore, a supporting member detector 53 for detecting the supporting member 52, which is movable up and down, is disposed in the vicinity of the bottom surface of the liquid accommodation unit 21. The supporting member detector 53 is a sensor which measures a light transmittance or light reflectance. When the ejection liquid 31 is consumed and the supporting member 52 is lowered, the supporting member detector 53 detects the supporting member 52 and thereby judges whether or not the ejection liquid 31 in the liquid accommodation unit 21 is insufficient.

From the above, according to the embodiment shown in FIG. 8, the supporting member 52 and the elastic film 48 move up and down in accordance with the amount of the ejection liquid 31 in the liquid accommodation unit 21, and it is possible to restrict the amount of deformation of the elastic film 48 to a uniform range during a normal recording operation. Consequently, a beneficial effect is obtained in that the amount of the non-volatile liquid 32 is minimized and cost reductions can be achieved. Furthermore, since the elastic film 48 never remains in a state of great deformation for a long period of time, a beneficial effect is obtained in that the life of the elastic film 48 can be extended.

Figure 9:
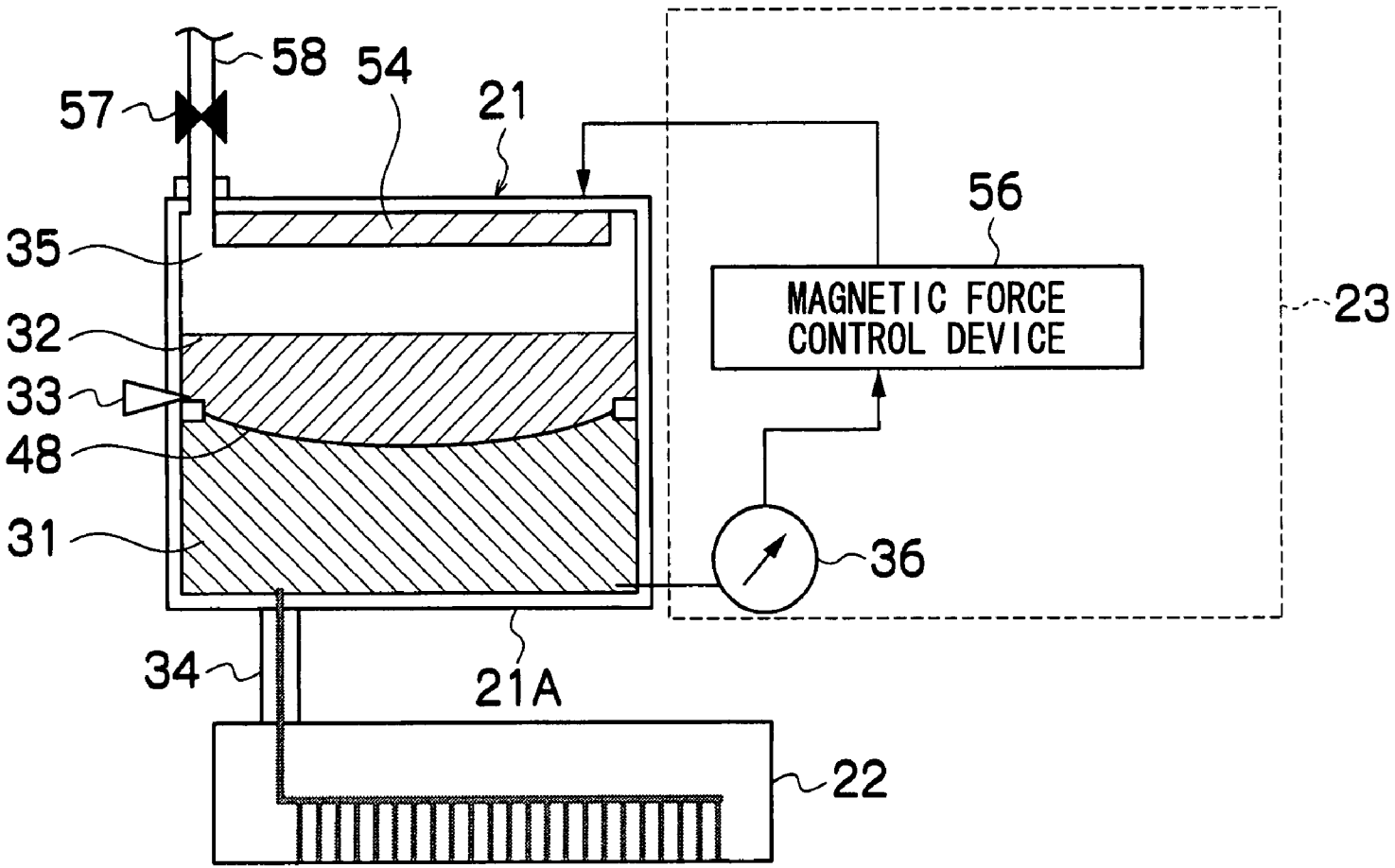
FIG. 9 is a diagram showing an example where the pressure of the ejection liquid is controlled by means of the magnetic force of a magnetic force generating apparatus.

FIG. 9 is a diagram showing another compositional example of the liquid ejection apparatus in which the pressure of the ejection liquid 31 in the liquid accommodation unit 21 is controlled by means of the magnetic force of a magnetic force generating apparatus 54. The non-volatile liquid 32 is a magnetic fluid (e.g., "magnetorheological fluid") and the magnetic force generating apparatus 54 is disposed above the non-volatile liquid 32, as shown in FIG. 9. The magnetic fluid may contain a magnetic metal (iron, nickel, cobalt) in the form of a powder, a magnetic metal salt (a nitrate salt or an acetate salt of a magnetic metal), or a magnetic ionic liquid (e.g., 1-butyl-3-methylimidazolium tetrachloroferide, which is also referred to simply as "[bmim]$FeCl_4$"), for example.

Moreover, a liquid detection device 33 for detecting the non-volatile liquid 32 is disposed in a position in the vicinity of the position at which the elastic film 48 is fixed, and preferably, it is disposed at a distance of 0 mm to 5 mm above the fixing position. When the remaining amount of the ejection liquid 31 has reduced and the level of the non-volatile liquid 32 (i.e., magnetic fluid) is accordingly lowered, the liquid detection device 33 detects the air 35, which is present above the non-volatile liquid 32, and judges whether or not the ejection liquid 31 is insufficient. Furthermore, a flow channel 58 which includes a valve 57 is provided above the liquid accommodation unit 21, and the air 35 is supplied to the liquid accommodation unit 21 through the flow channel 58.

On the basis of this composition, in the embodiment shown in FIG. 9, the pressure of the ejection liquid 31 in the liquid accommodation unit 21 is controlled by controlling the magnetic force of the magnetic force generating apparatus 54 by means of a magnetic force control apparatus 56 in the pressure adjustment device 23.

If the pressure is adjusted by means of a pump, then the oscillations of the pump drive action are transmitted to the air 35 inside the liquid accommodation unit 21, and there is a possibility that this will have an adverse effect on the pressure adjustment in the form of noise. However, according to the embodiment shown in FIG. 9, since continuous operation becomes possible, and the occurrence of oscillation is prevented, then more accurate pressure adjustment becomes possible.

General Composition of Inkjet Recording Apparatus

Figure 10:
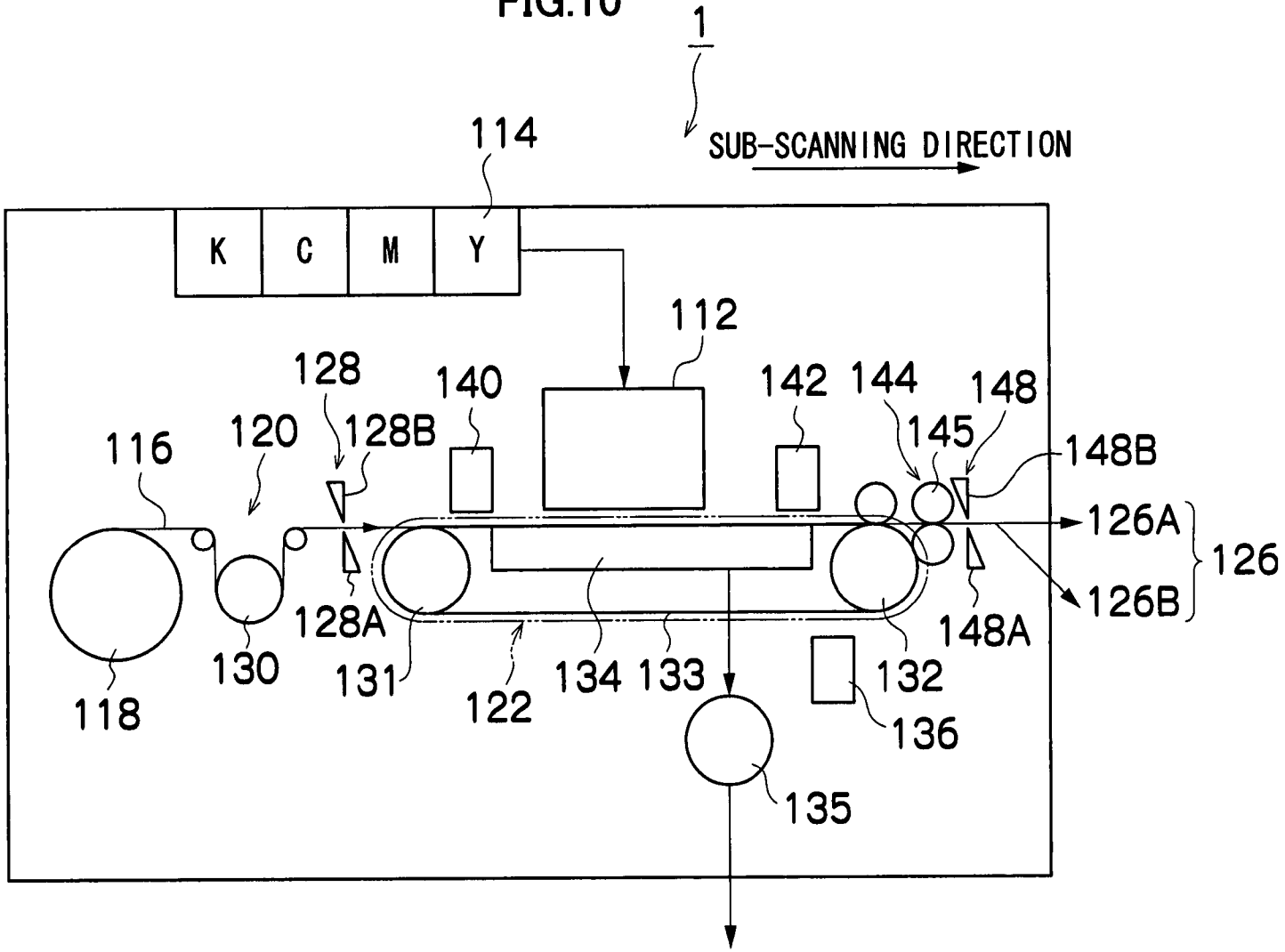
FIG. 10 is a general schematic drawing of an inkjet recording apparatus according to an embodiment of the present invention.

FIG. 10 is a general schematic drawing of an inkjet recording apparatus 1 according to an embodiment of the image forming apparatus of the present invention. The inkjet recording apparatus 1 includes: a print unit 112 having a plurality of recording heads 22K, 22C, 22M, and 22Y (generally referred to as the "recording heads 22", shown in FIG. 11) for ink colors of black (K), cyan (C), magenta (M), and yellow (Y), respectively; an ink storing and loading unit 114, which stores inks of K, C, M and Y to be supplied to the recording heads 22K, 22C, 22M, and 22Y; a paper supply unit 118, which supplies recording paper 116; a decurling unit 120, which removes curl in the recording paper 116; a suction belt conveyance unit 122, which is disposed facing the nozzle face (ink-droplet ejection face) of the print unit 112 and conveys the recording paper 116 while keeping the recording paper 116 flat; a print determination unit 124 which determines the print results of the print unit 112; and a paper output unit 126, which outputs image-printed recording paper (printed matter) to the exterior.

In FIG. 10, a magazine for rolled paper (continuous paper) is shown as an example of the paper supply unit 118; however, more magazines with paper differences such as paper width and quality may be jointly provided.

In the case of the configuration in which roll paper is used, a cutter 128 is provided as shown in FIG. 10, and the continuous paper is cut into a desired size by the cutter 128. The cutter 128 has a stationary blade 128A, whose length is not less than the width of the conveyor pathway of the recording paper 116, and a round blade 128B, which moves along the stationary blade 128A. The stationary blade 128A is disposed on the reverse side of the printed surface of the recording paper 116, and the round blade 128B is disposed on the printed surface side across the conveyor pathway. When cut papers are used, the cutter 128 is not required.

In the case of a configuration in which a plurality of types of recording paper can be used, it is preferable that an information recording medium such as a bar code and a wireless tag containing information about the type of paper is attached to the magazine, and by reading the information contained in the information recording medium with a predetermined reading device, the type of paper to be used is automatically determined, and ink-droplet ejection is controlled so that the ink-droplets are ejected in an appropriate manner in accordance with the type of paper.

The recording paper 116 delivered from the paper supply unit 118 retains curl due to having been loaded in the magazine. In order to remove the curl, heat is applied to the recording paper 116 in the decurling unit 120 by a heating drum 130 in the direction opposite to the curl direction in the magazine.

The decurled and cut recording paper 116 is delivered to the suction belt conveyance unit 122. The suction belt conveyance unit 122 has a configuration in which an endless belt 133 is set around rollers 131 and 132 so that the portion of the endless belt 133 facing at least the nozzle face of the print unit 112 forms a plane.

The belt 133 has a width that is greater than the width of the recording paper 116, and a plurality of suction apertures (not shown) are formed on the belt surface. A suction chamber 134 is disposed in a position facing the nozzle surface of the print unit 112 on the interior side of the belt 133, which is set around the rollers 131 and 132, as shown in FIG. 10; and a negative pressure is generated by suctioning air from the suction chamber 134 by means of a fan 135, thereby the recording paper 116 on the belt 133 is held by suction.

The belt 133 is driven in the clockwise direction in FIG. 10 by the motive force of a motor (not shown) being transmitted to at least one of the rollers 131 and 132, which the belt 133 is set around, and the recording paper 116 held on the belt 133 is conveyed in the sub-scanning direction (the paper conveyance direction) in FIG. 10.

Since ink adheres to the belt 133 when a marginless print job or the like is performed, a belt-cleaning unit 136 is disposed in a predetermined position (a suitable position outside the printing area) on the exterior side of the belt 133.

A heating fan 140 is disposed on the upstream side of the print unit 112 in the conveyance pathway formed by the suction belt conveyance unit 122. The heating fan 140 blows heated air onto the recording paper 116 to heat the recording paper 116 immediately before printing so that the ink deposited on the recording paper 116 dries more easily.

The ink storing and loading unit 114 has ink tanks for storing the inks of the colors corresponding to the respective recording heads 22 (22K, 22C, 22M, and 22Y shown in FIG. 11), and the respective tanks are connected to the recording heads 22 by means of channels (not shown).

A post-drying unit 142 is disposed following the print unit 112. The post-drying unit 142 is a device to dry the printed image surface, and includes a heating fan, for example. It is preferable to avoid contact with the printed surface until the printed ink dries, and a device that blows heated air onto the printed surface is preferable.

A heating/pressurizing unit 144 is disposed following the post-drying unit 142. The heating/pressurizing unit 144 is a device to control the glossiness of the image surface, and the image surface is pressed with a pressure roller 145 having a predetermined uneven surface shape while the image surface is heated, and the uneven shape is transferred to the image surface.

The printed matter generated in this manner is output from the paper output unit 126. The target print (i.e., the result of printing the target image) and the test print are preferably output separately. In the inkjet recording apparatus 1, a sorting device (not shown) is provided for switching the outputting pathways in order to sort the printed matter with the target print and the printed matter with the test print, and to send them to paper output units 126A and 126B, respectively. When the target print and the test print are simultaneously formed in parallel on the same large sheet of paper, the test print portion is cut and separated by a cutter (second cutter) 148. The cutter 148 is disposed directly in front of the paper output unit 126, and is used for cutting the test print portion from the target print portion when a test print has been performed in the blank portion of the target print. The structure of the cutter 148 is the same as the first cutter 128 described above, and has a stationary blade 148A and a round blade 148B.

Description of Print Unit

Figure 11:
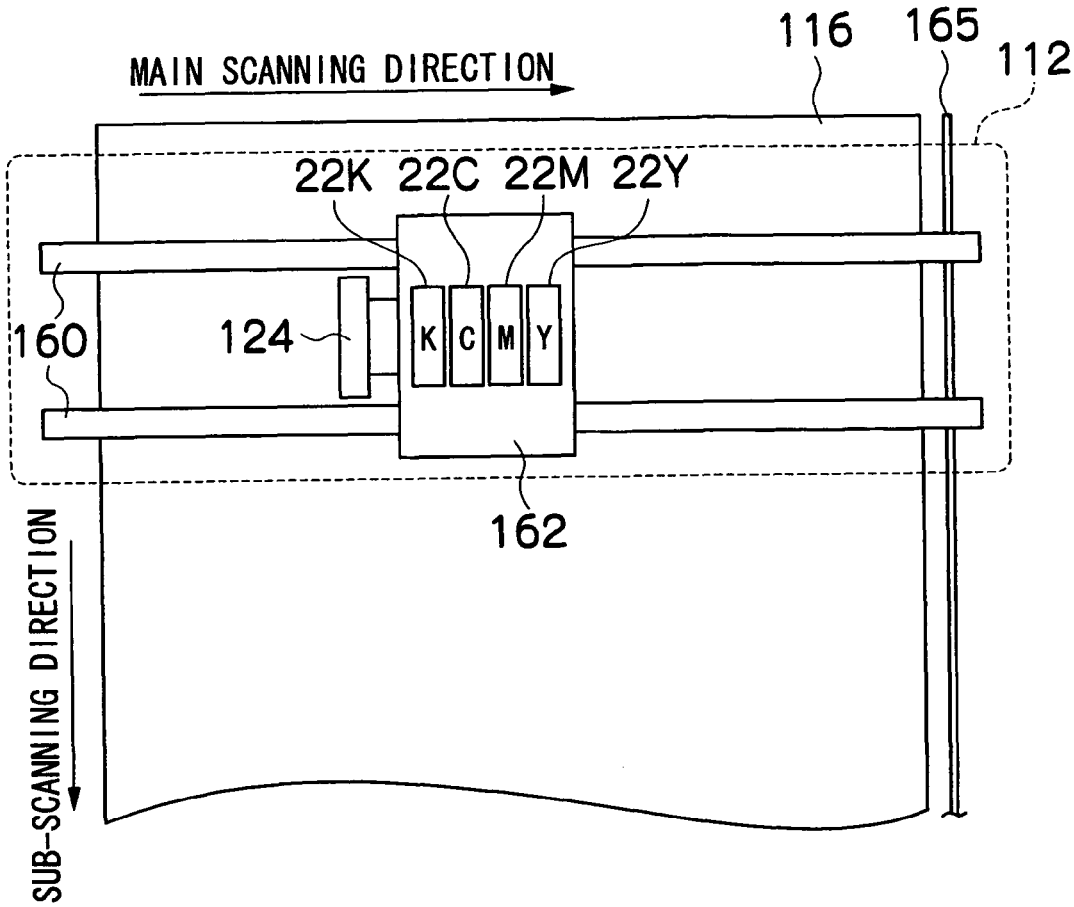
FIG. 11 is a principal plan diagram showing the peripheral area of a print unit of the inkjet recording apparatus.

Next, the print unit 112 including the above-described liquid ejection apparatus is described. FIG. 11 is a principal plan diagram showing the periphery of the print unit 112 of the inkjet recording apparatus 1. The print unit 112 is provided with a carriage 162, which is movable reciprocally along two guide rails 160 extending in the breadthways direction of recording paper 116 (the main scanning direction). The recording heads 22K, 22C, 22M, and 22Y and a print determination unit (scanner unit) 124 are detachably mounted on the carriage 162, in such a manner that they can scan the recording paper 116 in the main scanning direction with the carriage 162.

The print determination unit 124 includes sensors 164 (shown in FIG. 12) for capturing recorded images, and it functions as a device for reading in a test pattern recorded by the recording heads 22 and thereby checking the ink ejection state of the recording heads 22.

The recording paper conveyance amount determination sensor (conveyance amount sensor) 165 is a device which measures the conveyance amount in the sub-scanning direction of the recording paper 116, and it comprises photoelectric sensors arranged following a substantially parallel direction with respect to the sub-scanning direction. The amount of conveyance of the recording paper 116 is determined on the basis of the sensor signal obtained from this conveyance amount sensor 165.

Figure 12:
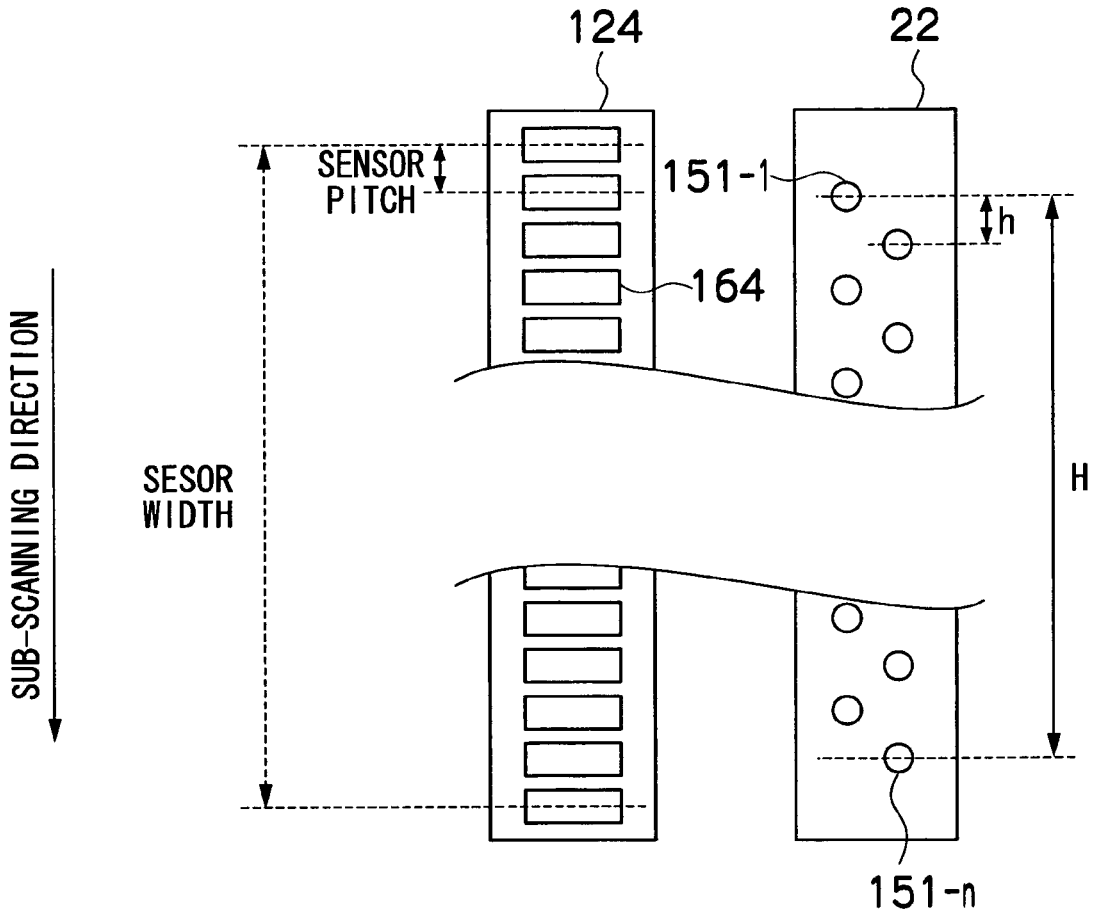
FIG. 12 is an illustrative diagram showing a nozzle face of a recording head and a sensor face of a print determination unit in the inkjet recording apparatus.

FIG. 12 is an illustrative diagram showing a nozzle face of one of the recording heads 22 and a sensor face of the print determination unit 124. As shown in FIG. 12, a plurality of nozzles 151-1 to **151-*n* are arranged in a staggered matrix fashion in the recording head 22**, and the nozzle density (nozzle pitch h) in the sub-scanning direction is 1200 nozzles per inch.

The nozzle pitch h in the staggered nozzle arrangement shown in FIG. 12 is the nozzle pitch (the distance between the centers of the nozzles) in a projected nozzle row, which is obtained by projecting the respective nozzles 151-1 to **151-*n*** to an alignment in the sub-scanning direction.

A plurality of sensors 164 are arranged in a line configuration (a one-dimensional configuration) on the sensor face of the print determination unit 124. The sensor density (sensor pitch) in the sub-scanning direction is the same as the nozzle density of the recording head 22 (1200 sensors per inch), and the reading resolution of the print determination section 124 is 1200 dpi.

The sensor width (reading width) of the print determination unit 124 is set to be broader than the nozzle width (printing width) of the recording head 22. Accordingly, even if relative positional error occurs between the recording head 22 and the print determination unit 124 mounted on the carriage 162 (see FIG. 11), the print determination unit 124 is able to reliably read the test pattern formed by the recording head 22.

Figure 13A:
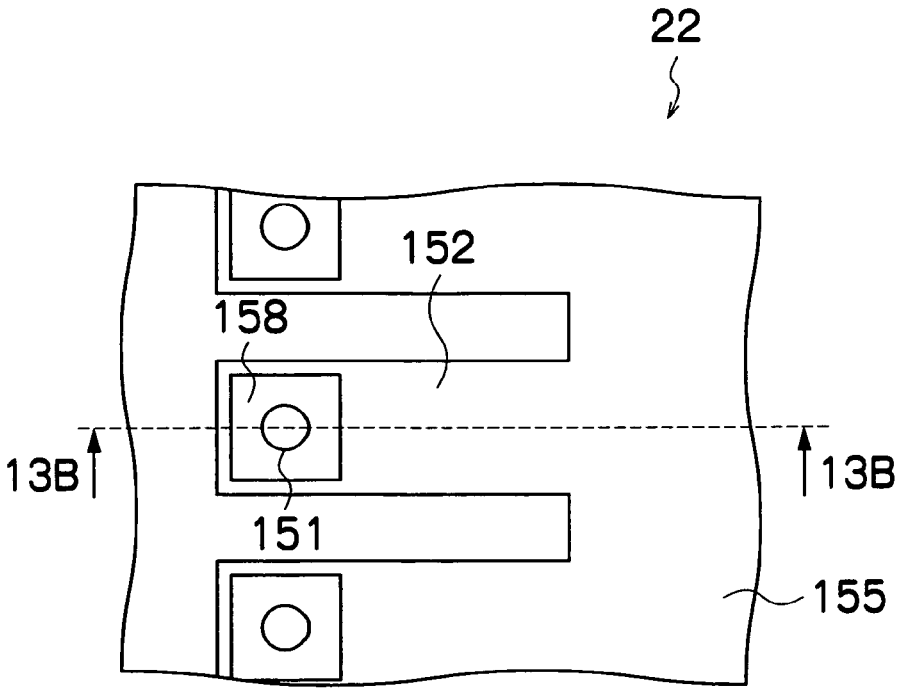
FIGS. 13A and 13B are schematic drawings of the internal structure of the recording head.
Figure 13B:
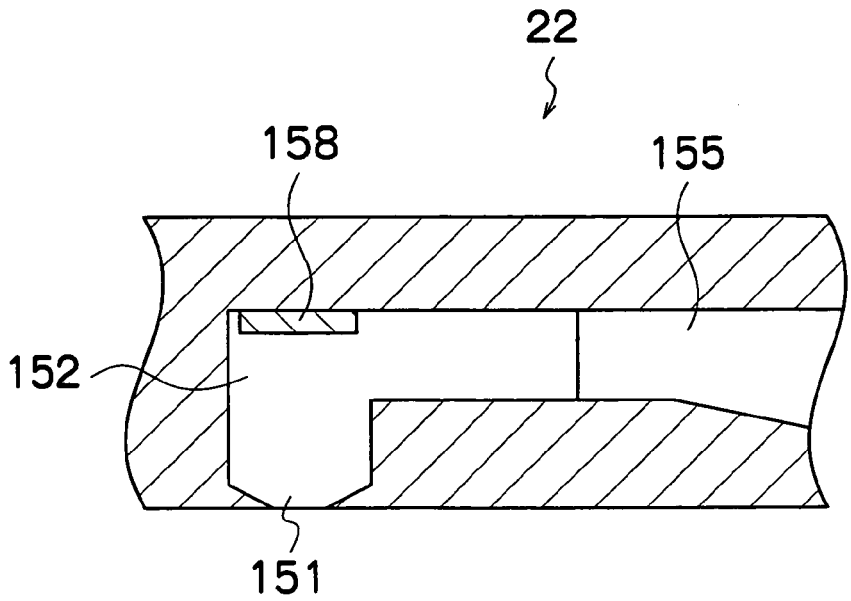

FIGS. 13A and 13B are schematic drawings showing the internal structure of the recording head 22, and FIG. 13A is a plan view perspective diagram showing a portion of the recording head 22, and FIG. 13B is a cross-sectional diagram along line 13B-13B in FIG. 13A. In the recording head 22, individual flow channels 152 are arranged so as to correspond respectively to the nozzles 151. A heating element 158 is arranged on a side wall of each of the individual flow channels 152, to form an ejection device for ejecting ink droplets from each of the nozzles 151. In the present embodiment, the heating element 158 is disposed on the wall opposing the nozzle 151. The individual flow channels 152 are connected to a common flow channel 155. Ink supplied from the ink storing and loading unit 114 in FIG. 10 is accumulated in the common flow channel 155, and the ink is distributed and supplied to the respective individual flow channels 152 from the common flow channel 155.

According to this composition, when a prescribed drive voltage is supplied to the heating element 158, a bubble grows in the ink inside the individual flow channel 152, due to the heat generated by the heating element 158, and an ink droplet is ejected from the nozzle 151 by the pressure created by this bubble. After ink ejection, further ink is supplied from the common flow channel 155 to the individual flow channel 152.

Apart from this, it is also possible to use a piezoelectric element as an ejection device. In this case, when the piezoelectric element is caused to deform by applying a drive voltage, the volume of the pressure chamber changes, and therefore ink is ejected from the nozzle due to the resulting pressure change in the chamber.

Description of Control System

Figure 14:
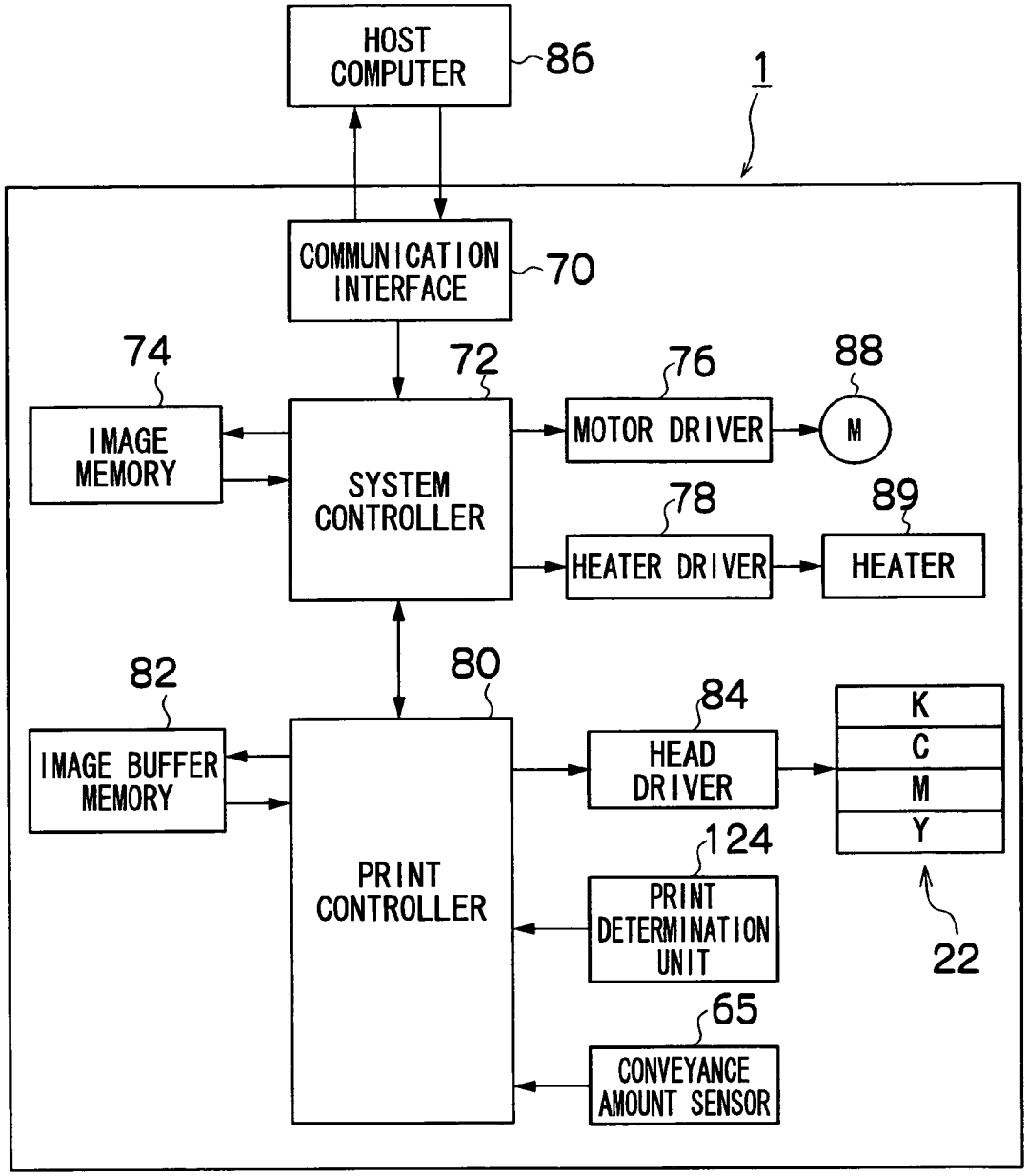
FIG. 14 is a principal block diagram showing a system composition of the inkjet recording apparatus.
Figure 15:
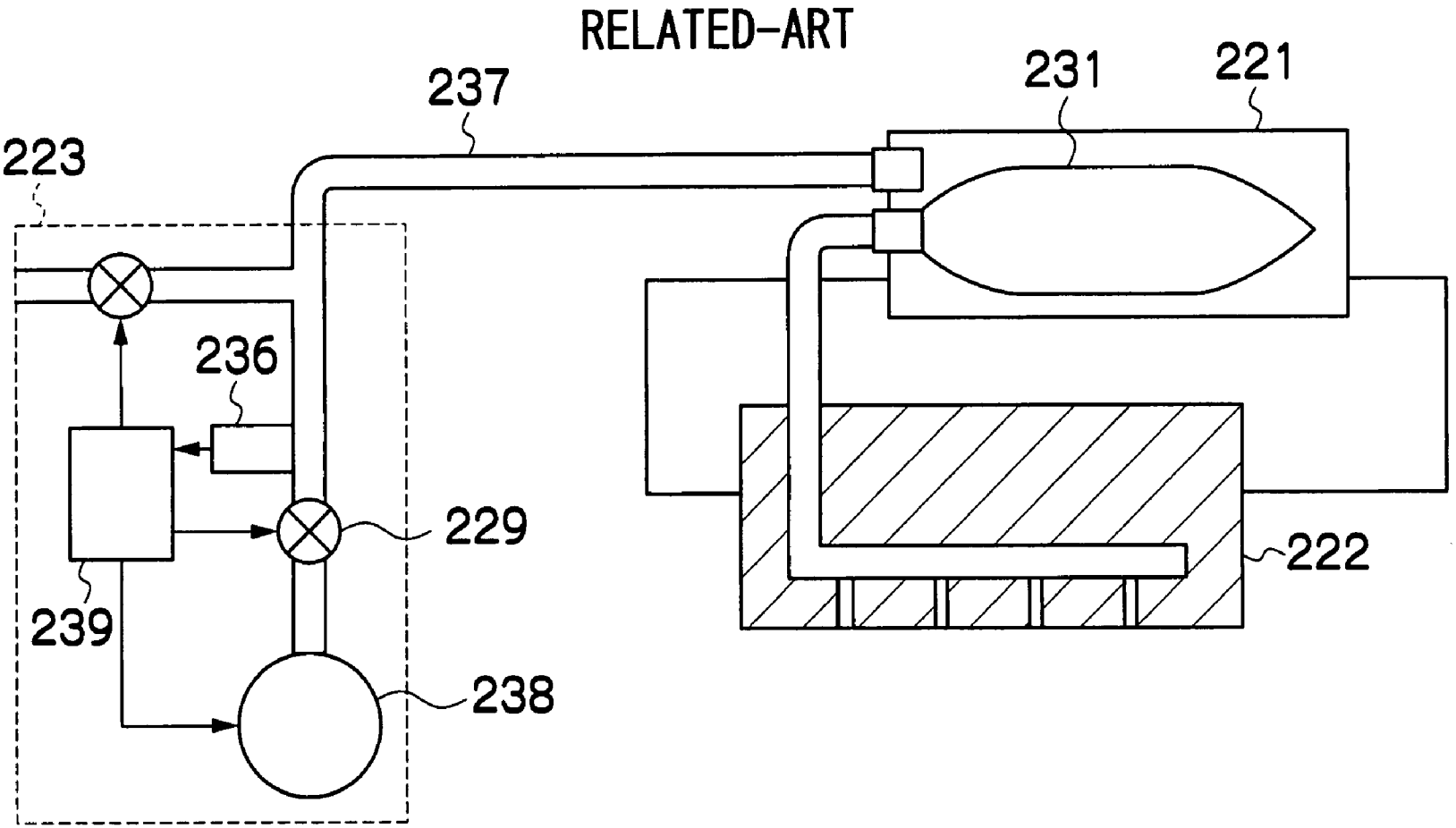
FIG. 15 is a general schematic drawing of a liquid ejection apparatus in the related art.

FIG. 14 is a principal block diagram showing the system configuration of the inkjet recording apparatus 1. The inkjet recording apparatus 1 includes a communication interface 70, a system controller 72, an image memory 74, a motor driver 76, a heater driver 78, a print controller 80, an image buffer memory 82, a head driver 84, and the like.

The communication interface 70 is an interface unit for receiving image data sent from a host computer 86. A serial interface or a parallel interface may be used as the communication interface 70. A buffer memory (not shown) may be mounted in this portion in order to increase the communication speed.

The image data sent from the host computer 86 is received by the inkjet recording apparatus 10 through the communication interface 70, and is temporarily stored in the image memory 74. The image memory 74 is a storage device for temporarily storing images inputted through the communication interface 70, and data is written and read to and from the image memory 74 through the system controller 72.

The system controller 72 is a control unit for controlling the various sections, such as the communications interface 70, the image memory 74, the motor driver 76, the heater driver 78, and the like. The system controller 72 is constituted by a central processing unit (CPU) and peripheral circuits thereof, and the like, and in addition to controlling communications with the host computer 86 and controlling reading and writing from and to the image memory 74, or the like, it also generates a control signal for controlling the motor 88 of the conveyance system and the heater 89.

The motor driver (drive circuit) 76 drives the motor 88 in accordance with commands from the system controller 72. The heater driver (drive circuit) 78 drives the heater 89 of the post-drying unit 42 or other units in accordance with commands from the system controller 72.

The print controller 80 has a signal processing function for performing various tasks, compensations, and other types of processing for generating print control signals from the image data stored in the image memory 74 in accordance with commands from the system controller 72 so as to supply the generated print control signal (dot data) to the head driver 84. Prescribed signal processing is carried out in the print controller 80, and the ejection amount and the ejection timing of the ink droplets from the recording heads 22 are controlled through the head driver 84, on the basis of the print data. By this means, prescribed dot size and dot positions can be achieved.

The print controller 80 is provided with the image buffer memory 82; and image data, parameters, and other data are temporarily stored in the image buffer memory 82 when image data is processed in the print controller 80.

The head driver 84 generates drive signals for driving the heating elements 158 of the respective colors in the recording heads 22 (see FIGS. 13A and 13B) on the basis of the print data supplied from the print controller 80, and supplies the drive signals thus generated to the heating elements 158. A feedback control system for maintaining constant drive conditions for the recording heads 22 may be included in the head driver 84.

As stated previously, the print determination unit 124 reads in a test pattern recorded by the recording heads 22, and performs prescribed signal processing, and the like, in order to determine the ink ejection status of the recording heads 22 (the presence/absence of ejection, the dot sizes, dot depositing positions, and the like) (in other words, it determines variations in the respective nozzles 151). The print determination unit 124 supplies the determination results to the print controller 80. According to requirements, the print controller 80 makes various corrections with respect to the recording heads 22 on the basis of information obtained from the print determination unit 124.

The conveyance amount sensor 165 determines the amount of conveyance of the recording paper 137 in the sub-scanning direction, and the sensor signal obtained from the conveyance amount sensor 165 (conveyance amount information) is supplied to the print controller 180.

The liquid ejection apparatus, the image forming apparatus and the liquid ejection method according to the present invention were described in detail above, but the present invention is not limited to these examples, and it is of course possible for improvements or modifications of various kinds to be implemented, within a range which does not deviate from the essence of the present invention.

For example, the liquid ejection apparatus or the liquid ejection method of the present invention may also be applied to an inkjet recording apparatus using a line system, in which printing is carried out by means of a fixed recording head, which has nozzles arranged in the breadthways direction of the recording paper.

It should be understood, however, that there is no intention to limit the invention to the specific forms disclosed, but on the contrary, the invention is to cover all modifications, alternate constructions and equivalents falling within the spirit and scope of the invention as expressed in the appended claims.

What is claimed is:

1. A liquid ejection apparatus comprising:

a recording head which includes a nozzle and an ejection device, the ejection device ejecting an ejection liquid through the nozzle by applying pressure to the ejection liquid in the recording head;

a liquid accommodation unit which accommodates a gas, the ejection liquid to be supplied to the recording head, and a non-volatile liquid having a permeability to the gas lower than the ejection liquid, the ejection liquid being separated from the gas by the non-volatile liquid;

a connection channel which connects the recording head with a liquid storage part of the liquid accommodation unit accommodating the ejection liquid to supply the ejection liquid accommodated in the liquid accommodation unit to the recording head; and a pressure control unit which controls pressure of the ejection liquid in the liquid accommodation unit by moving the gas into and out of the liquid accommodation unit.

2. The liquid ejection apparatus as defined in claim 1, wherein the non-volatile liquid has a specific gravity less than the ejection liquid.

3. The liquid ejection apparatus as defined in claim 1, wherein:

the liquid accommodation unit includes a porous member impregnated with the non-volatile liquid; and the ejection liquid is separated from the gas by the non-volatile liquid held in the porous member.

4. The liquid ejection apparatus as defined in claim 1, wherein the liquid accommodation unit includes an elastic film disposed between the ejection liquid and the non-volatile liquid.

5. The liquid ejection apparatus as defined in claim 4, wherein the liquid accommodation unit further includes an elastic film disposed between the non-volatile liquid and the gas.

6. The liquid ejection apparatus as defined in claim 4, wherein the liquid accommodation unit includes an elastic film supporting member which movably supports the elastic film.

7. The liquid ejection apparatus as defined in claim 1, wherein the non-volatile liquid has a light transmittance less than the ejection liquid.

8. The liquid ejection apparatus as defined in claim 1, wherein the non-volatile liquid has a light reflectance greater than the ejection liquid.

9. An image forming apparatus comprising the liquid ejection apparatus as defined in claim 1.

10. The liquid ejection apparatus as defined in claim 1, wherein the connection channel is connected to a bottom of the liquid accommodation unit, wherein the bottom is a downside in terms of a vertical direction.

11. A liquid ejection apparatus comprising:

a recording head which includes a nozzle and an ejection device, the ejection device ejecting an ejection liquid through the nozzle by applying pressure to the ejection liquid in the recording head;

a liquid accommodation unit which is in connection with the recording head and which accommodates a gas, the ejection liquid to be supplied to the recording head, and a non-volatile liquid having a permeability to the gas lower than the ejection liquid, the liquid accommodation unit including an inelastic member that separates the ejection liquid from the gas, and an elastic film that separates the non-volatile liquid from the ejection liquid and the gas; and a pressure control unit which controls pressure of the ejection liquid in the liquid accommodation unit by moving the gas into and out of the liquid accommodation unit.

12. An image forming apparatus comprising the liquid ejection apparatus as defined in claim 11.

* * * * *